US008590419B2

(12) United States Patent
Finegan et al.

(10) Patent No.: US 8,590,419 B2
(45) Date of Patent: Nov. 26, 2013

(54) REACTOR COOLANT PUMP FLYWHEEL

(75) Inventors: John Raymond Finegan, Pittsburgh, PA (US); Francis Joseph Kreke, New Kensington, PA (US); John Joseph Casamassa, Wexford, PA (US)

(73) Assignee: Curtiss-Wright Electro-Mechanical Corp., Cheswick, PA (US)

( * ) Notice: Subject to any disclaimer, the term of this patent is extended or adjusted under 35 U.S.C. 154(b) by 605 days.

(21) Appl. No.: 12/470,320

(22) Filed: May 21, 2009

(65) Prior Publication Data

US 2010/0091931 A1 Apr. 15, 2010

Related U.S. Application Data

(60) Provisional application No. 61/057,446, filed on May 30, 2008.

(51) Int. Cl.
*F16F 15/315* (2006.01)
*G21C 15/24* (2006.01)
*F04D 13/06* (2006.01)

(52) U.S. Cl.
USPC ..... 74/572.21; 74/572.2; 417/423.1; 417/424.2; 376/210; 376/361

(58) Field of Classification Search
None
See application file for complete search history.

(56) References Cited

U.S. PATENT DOCUMENTS

| | | | | |
|---|---|---|---|---|
| 4,052,260 | A | | 10/1977 | Forster et al. |
| 4,754,606 | A | | 7/1988 | Nam |
| 4,886,430 | A | | 12/1989 | Veronesi et al. |
| 5,165,305 | A | | 11/1992 | Veronesi |
| 5,356,273 | A | * | 10/1994 | Nixon ..... 417/423.12 |
| 5,775,176 | A | | 7/1998 | Bender et al. |

OTHER PUBLICATIONS

International Preliminary Report on Patentability for corresponding to International Application No. PCT/US2009/044878, Sep. 1, 2010.
International Search Report for corresponding to International Application No. PCT/US2009/044878, Sep. 30, 2009.
Written Opinion for corresponding International Application No. PCT/US2009/044878, Sep. 30, 2009.

* cited by examiner

*Primary Examiner* — Johannes P Mondt
(74) *Attorney, Agent, or Firm* — Reed Smith LLP

(57) ABSTRACT

A flywheel for a pump, and in particular a flywheel having a number of high density segments for use in a nuclear reactor coolant pump. The flywheel includes an inner member and an outer member. A number of high density segments are provided between the inner and outer members. The high density segments may be formed from a tungsten based alloy. A preselected gap is provided between each of the number of high density segments. The gap accommodates thermal expansion of each of the number of segments and resists the hoop stress effect/keystoning of the segments.

22 Claims, 4 Drawing Sheets

REACTOR COOLANT PUMP FLYWHEEL

CROSS-REFERENCE TO RELATED APPLICATION

This application claims the benefit under 35 U.S.C. §119 (e) of the earlier filing date of U.S. Provisional Application Ser. No. 61/057,446 filed on May 30, 2008, the contents of which are hereby incorporated by reference.

GOVERNMENT INTEREST

The United States Government has rights in this invention pursuant to Contract No. DE-FC07-07ID14779 between the U.S. Department of Energy and Westinghouse Electric Company.

FIELD OF INVENTION

The invention relates generally to a flywheel for use in a pump, and in particular to a high inertia flywheel using a number of high density segments for use in a nuclear reactor coolant pump.

BACKGROUND OF THE INVENTION

Flywheels are used in centrifugal pumps to mechanically store potential energy during operation of the pump, which energy may be utilized to maintain rotation of the pump in the event of loss of motive power. In nuclear reactors, this technology helps to maintain coolant circulation through the reactor core.

Exemplary flywheels for use in reactor coolant pumps are described in U.S. Pat. Nos. 4,886,430 and 5,165,305, the disclosures of which are incorporated by reference herein.

A need, however, exists for an improved reactor coolant pump flywheel.

SUMMARY OF THE INVENTION

In accordance with an embodiment of the invention, the invention provides a flywheel for a pump, and in particular a flywheel having a number of high density segments for use in a nuclear reactor coolant pump.

In accordance with an embodiment of the invention, the flywheel includes an inner member and an outer member. A number of high density segments are provided between the inner member and the outer member. The high density segments may be formed from a tungsten based alloy. A preselected gap is provided between each of the number of high density segments. The gap accommodates thermal expansion of each of the number of segments and resists any hoop stress effect or keystoning of the segments. A number of upper pins and a number of lower pins are provided at an inner diameter of the segments in order to couple the number of segments to the inner member. An interference fit may be provided between the inner member, the segments and the outer member. A key, spline or interference fit is provided between the inner member and the rotatably operable shaft in order to couple the flywheel to the shaft. In combination with the pins and the coupling of the inner member to the rotatable operable shaft, the gap provides radial loading on the segments and gives the stability desired to resist motion which could show up as a balance change.

In accordance with an embodiment of the invention, the flywheel includes an upper end cap member, a lower end cap member and a shell member capping the upper and lower surfaces of the high density segments and at least a portion of the outer member. The cap members ensure that the high density segments and at least a portion of the outer member do not get immersed in a solvent. The cap members prevent corrosion of the high density segments and contamination of the coolant by the tungsten material of the high density segments. In addition, the cap members provide positive encapsulation of at least a portion of the outer member for an axial seismic or shock event without resorting to friction.

In accordance with an embodiment of the invention, a pair of flywheels is provided within the stator and casing of a nuclear reactor coolant pump, with one flywheel at each end of the pump in opposed relation to one another. The pump, according to one example of the invention, is for use in a pressurized water reactor nuclear power plant structured to generate at least 1000 MWe.

BRIEF DESCRIPTION OF THE DRAWINGS

For the invention to be clearly understood and readily practiced, the invention will be described in conjunction with the following FIGS., wherein like reference characters designate the same or similar elements, which FIGS. are incorporated into and constitute a part of the specification, wherein.

DETAILED DESCRIPTION OF THE INVENTION

Figure 1:
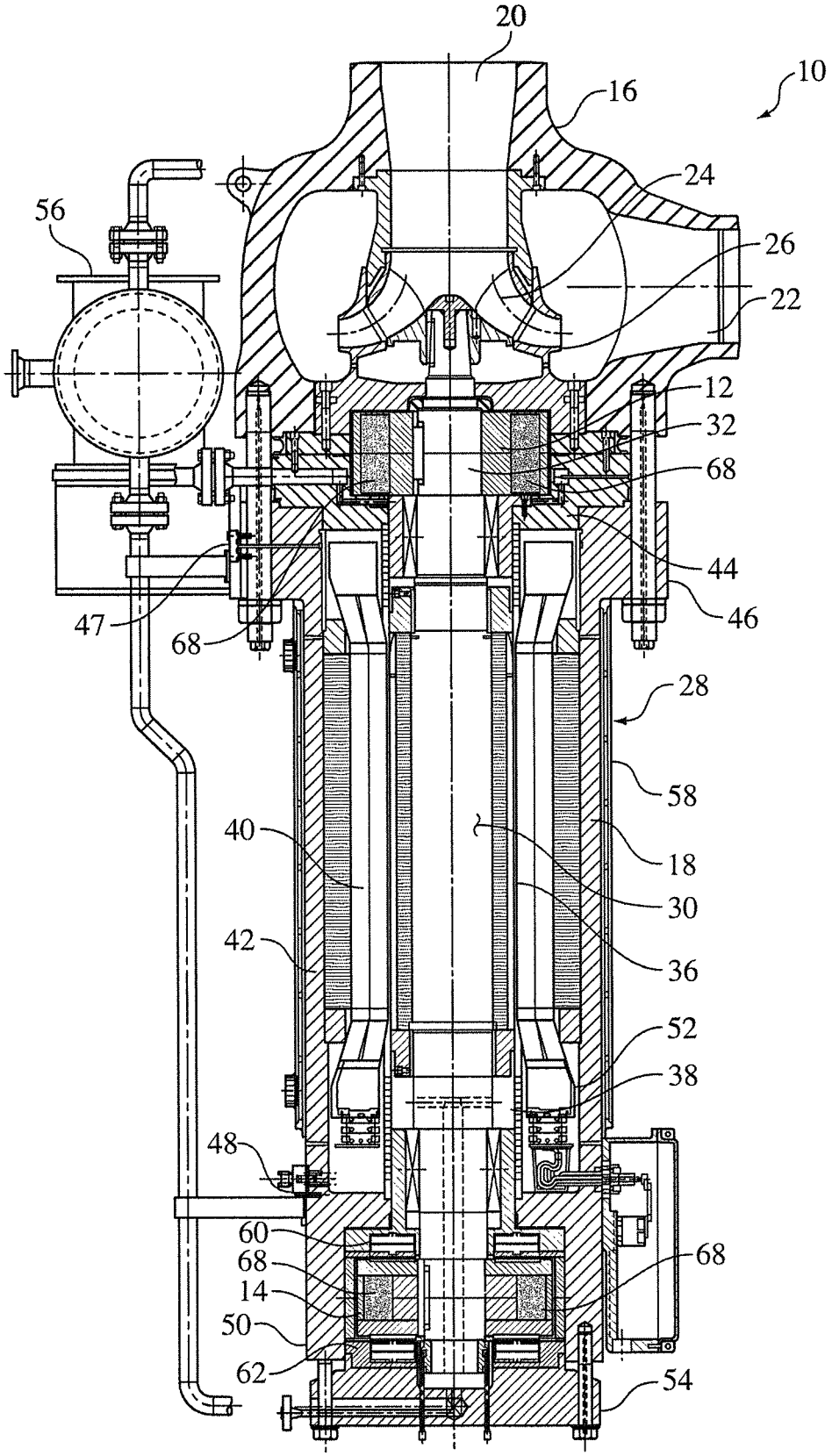
FIG. 1 is a side view, partially in cross-section, of a reactor coolant pump system having a number of flywheels incorporated therein.
Figures 2A, 2B:
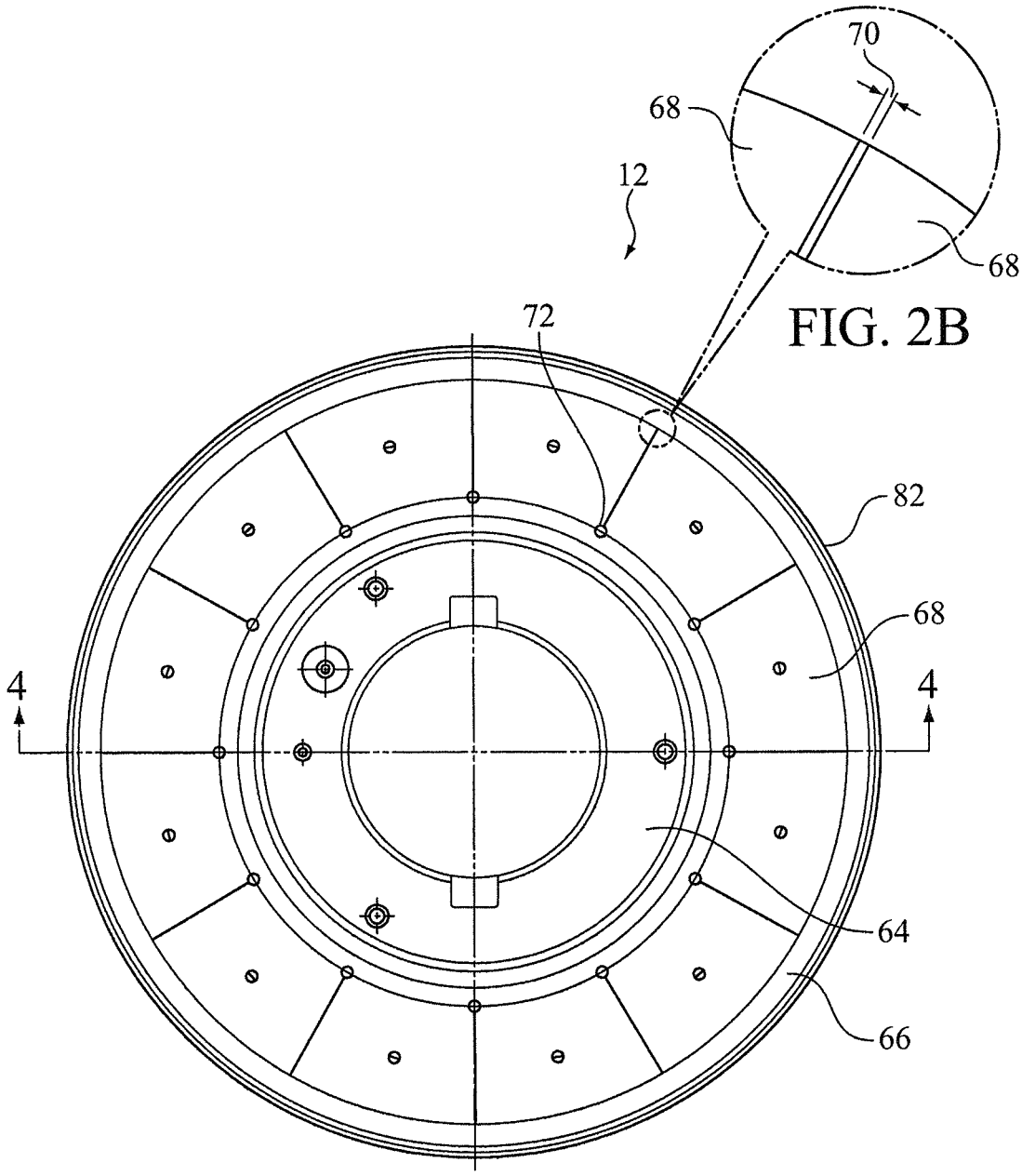
FIG. 2 is a plan view of an upper flywheel.
Figures 3A, 3B:
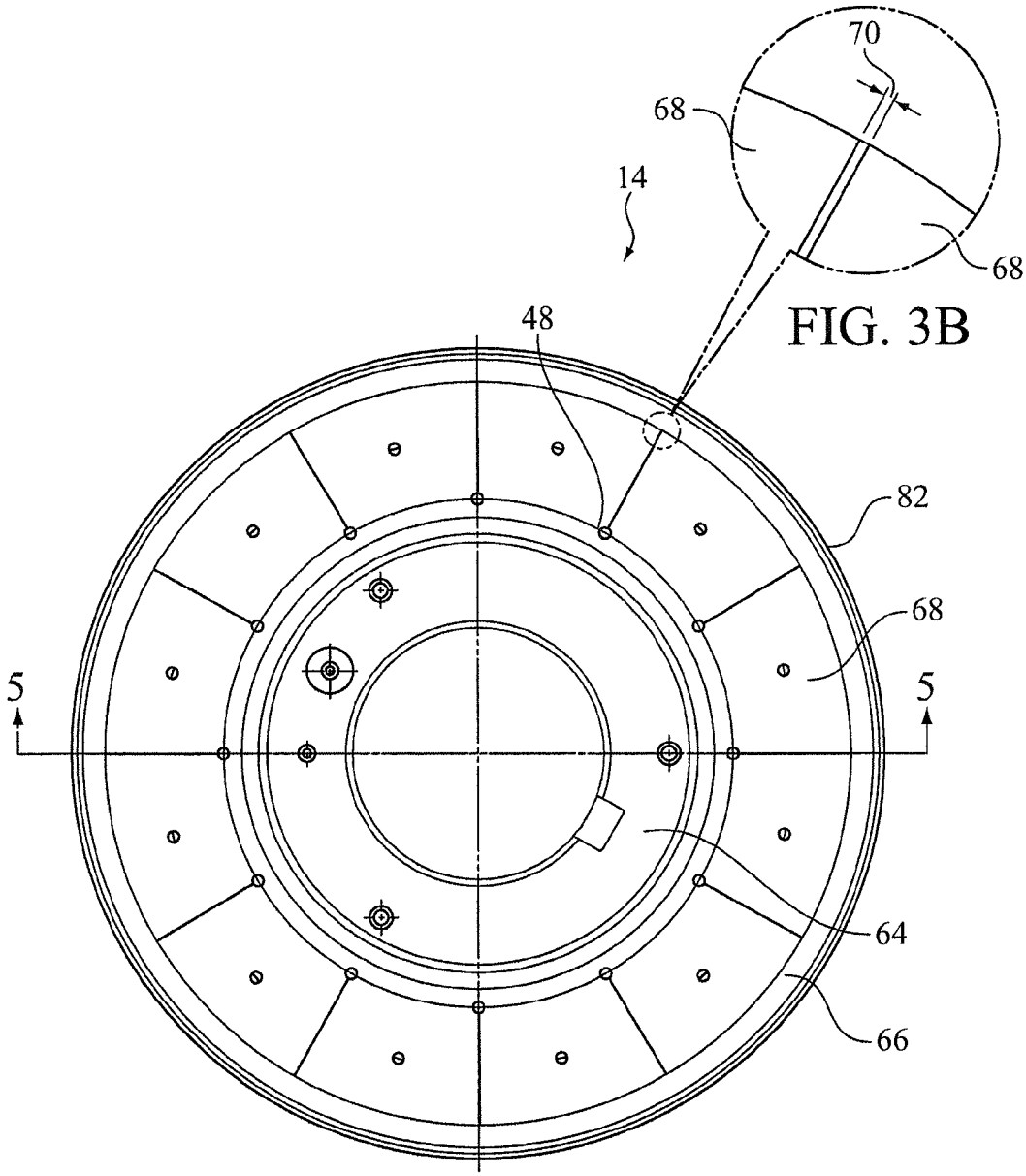
FIG. 3 is a plan view of a lower flywheel.

It is to be understood that the FIGS. and descriptions of the invention have been simplified to illustrate elements that are relevant for a clear understanding of the invention, while eliminating, for purposes of clarity, other elements that may be well known. Those of ordinary skill in the art will recognize that, such as, for example, all of the components of the reactor coolant pumps other than as shown in the FIGS. have not been described in detail herein for the purpose of simplifying the specification of the patent application.

For purposes of the description hereinafter, the terms "upper", "lower", "vertical", "horizontal", "axial", "top", "bottom", "aft", "behind", and derivatives thereof shall relate to the invention, as it is oriented in the drawing FIGS. However, it is to be understood that the invention may assume various alternative configurations except where expressly specified to the contrary. It is also to be understood that the specific elements illustrated in the FIGS. and described in the following specification are simply exemplary embodiments of the invention. Therefore, specific dimensions, orientations and other physical characteristics related to the embodiments disclosed herein are not to be considered limiting.

As used herein, the term "pin" means any suitable fastening, connecting or tightening mechanism such as dowel pins, fasteners, rivets, other connecting elements and the like. As used herein, the statement that two or more parts are "coupled" together means that the parts are joined together either directly or joined together indirectly through one or more intermediate parts.

The detailed description will be provided hereinbelow with reference to the attached drawings. In the drawings, like reference characters designate corresponding parts throughout the views.

Referring to FIG. 1, there is illustrated a reactor coolant pump generally designated by reference numeral 10 having a first or upper flywheel 12 and a second or lower flywheel 14 incorporated into a casing 16 and stator assembly 18 thereof. Pump 10 operates to circulate coolant fluid such as water. Pump casing 16 defines a suction nozzle 20 and a discharge nozzle 22. An impeller 24 is provided for centrifugally pumping the coolant fluid such that fluid is drawn through the suction nozzle 20, through an eye of the impeller 24, discharged through a diffuser 26 and out through the discharge nozzle 22.

Pump 10 further includes a motor 28 having a rotor assembly 30 mounted on a rotatably operable shaft 32 and the corresponding stator assembly 18. Rotor assembly 30 includes rotor can 36. Stator assembly 18 includes stator can 38, stator coils 40, stator shell 42, stator closure ring 44, stator main flange 46, stator vents 47, a stator lower flange 50, stator end turns 52 and stator cap 54. Pump 10 also includes an external heat exchanger 56 and stator cooling jacket 58 for removing heat generated within the pump 10.

Upper flywheel 12 is disposed proximate to the impeller end of the pump 10 coupled to shaft 32 within the pump casing 16. Lower flywheel 14 is disposed on the other end of shaft 32 in opposed relation to the upper flywheel 12 coupled to the shaft 32 within the pump stator assembly 18. Disposed on an upper side and a lower side of lower flywheel 14 are an upper thrust bearing 60 and a lower thrust bearing 62.

Flywheels 12 and 14 are constructed in a similar manner. Lower flywheel 14, however, has a different profile as can be seen by comparing FIGS. 4 and 5. The description provided for the upper flywheel 12 is equally applicable to the lower flywheel 14 and the details of the lower flywheel 14 have been omitted for the purpose of simplifying the specification of the patent application since the lower flywheel 14 is similar in construction to the upper flywheel 12.

Flywheel 12 includes an inner member 64 and outer member 66 wherein the inner member 64 may be an inner tubular cylindrical member and the outer member 66 may be an outer tubular cylindrical member. A number of high density segments 68 are provided between the inner and outer members 64, 66. The high density segments 68 may be formed from a tungsten based alloy. Other high density materials, however, are suitable. A preselected gap 70 is provided between each of the number of high density segments 68. The gap 70 accommodates thermal expansion and Poisson's effect of each of the number of segments 68 and resists any hoop stress effect/keystoning of the segments 68. The gap 70 in an embodiment is between about 0.010 to 0.050 inches (0.25 to 1.27 mm). An upper pin 72 and a lower pin 74 are provided at an inner diameter of the segments 68 at each gap 70 (see FIGS. 2-5). An interference or shrink fit may be provided between the inner member 64, segments 68 and the outer member 66. In particular, the outer member may be in an interference fit with at least one of the segments. A key 76 may be provided between the inner member 64 and the high density segments 68. In combination with the upper and lower pins 72, 74, key 76 and the coupling to the shaft 32, the gap 70 provides for only radial loading on the segments 68 and gives the stability needed to resist any motion which could show up as a balance change.

Figure 4:
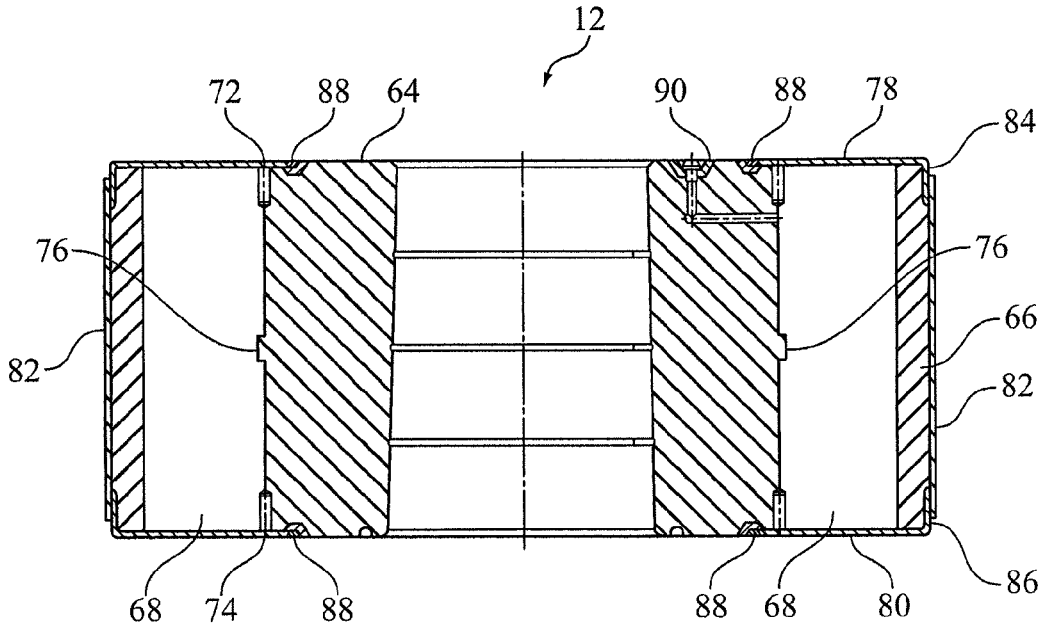
FIG. 4 is a cross-sectional view of an upper flywheel disposed near the impeller end of the pump.
Figure 5:
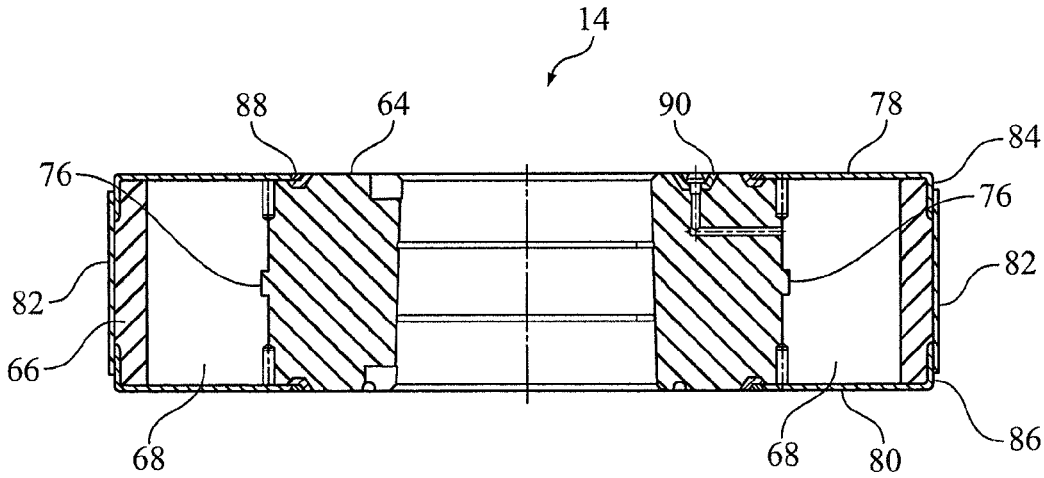
FIG. 5 is a cross-sectional view of the lower flywheel.

As can be seen in FIGS. 4 and 5, the flywheel includes an upper cap member 78, a lower cap member 80, and an outer shell member 82 that cap the high density segments 68 and at least a portion of the outer member 66. Shell member 82 wraps around the outer member 66 and is attached to upper cap member 78 and lower cap member 80 by welding. The outer diameters of upper cap member 78 and lower cap member 80 have lips 84, 86, respectively, which curl around the ends of the outer member 66. The purpose of the lips is to provide support for the shell member 82 should differential thermal expansion occur between the upper and lower cap members 78, 80 and the outer member 66. This allows for the difference in displacement to be gradual along the length of the lips 84, 86 so that the outer member 66 is not forced to span the discontinuity directly. The upper and lower cap members 78, 80 are welded to inner member 64 with welds at their inner diameters. In the illustrated embodiment, the flywheel also includes a leak test plug 90 for performing a leak test to make sure the welds 88 are leak tight.

Nothing in the above description is meant to limit the invention to any specific materials, geometry, or orientation of elements. Many parts/orientation substitutions are contemplated within the scope of the invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered only to facilitate comprehension of the invention and should not be construed to limit the scope thereof.

What is claimed is:

1. A flywheel for a pump, said flywheel being configured to rotate around an axis of rotation, the flywheel comprising:

an inner tubular member having an outer diameter;

an outer tubular member having an inner diameter;

a number of segments provided in a tubular space defined between the outer diameter of the tubular inner member and the inner diameter of the tubular outer member, said outer diameter of the tubular inner member and said inner diameter of the tubular outer member respectively defining an inner segment diameter and an outer segment diameter of said segments, wherein the tubular inner member, the tubular outer member and the number of segments are operably coupled to a rotatably operable shaft of the pump for rotation therewith, wherein the tubular outer member is in an interference fit with at least one of the segments, wherein a preselected gap is provided between each of the segments and is structured to accommodate thermal expansion of the segments, wherein the gap is structured to accommodate thermal expansion of each of the number of segments, and wherein the rotatable flywheel further comprises an upper pin and a lower pin, said lower pin positioned lower than said upper pin in a direction along the axis of rotation provided at each gap between the segments at the inner segment diameter.

2. The flywheel of claim 1 wherein the gap is structured to resist any hoop stress.

3. The flywheel of claim 1 wherein the gap is structured to provide radial loading of the number of segments.

4. The flywheel of claim 1 wherein the inner member is an inner tubular cylindrical member and the outer member is an outer tubular cylindrical member.

5. The flywheel of claim 1 further comprising an upper cap member and a lower cap member defining the spatial extent of the segments along the axis of rotation, and an outer shell member for containing the segments between the inner member and the outer member.

6. The flywheel of claim 1 wherein the segments comprise a tungsten based alloy.

7. The flywheel of claim 1 wherein the tubular inner member is in an interference fit with at least one of the segments.

8. The flywheel of claim 1 wherein the tubular inner member is configured to be in a splined engagement with the rotatable operable shaft of the pump.

9. A pump comprising:

a shaft being configured to rotate around an axis of rotation;

an impeller mounted on the shaft;

a motor engaged with the shaft for turning the impeller; and a first rotatable flywheel mounted on the shaft, the first flywheel comprising:

an first tubular inner member having an outer diameter;

an first tubular outer member having an inner diameter;

a first number of first segments provided in a first tubular space defined between the outer diameter of the first tubular inner member and the inner diameter of the first tubular outer member, said outer diameter of the first tubular inner member and said inner diameter of the first tubular outer member respectively defining a first inner segment diameter and a first outer segment diameter of said segments, wherein the first tubular inner member, the first tubular outer member and the first segments are operably coupled to a rotatably operable shaft of the pump for rotation therewith, wherein the first tubular outer member is in an interference fit with at least one of the first segments, wherein a first preselected gap is provided between each of the first segments and is structured to accommodate thermal expansion of the first segments, and wherein the first rotatable flywheel further comprises a first upper pin and a first lower pin provided at each first predetermined gap between the first segments at the first inner segment diameter.

10. The pump of claim 9 wherein the first preselected gap is structured to resist any hoop stress.

11. The pump of claim 9 wherein the first preselected gap is structured to provide radial loading of the first number of first segments.

12. The pump of claim 9 further comprising an upper cap member and a lower cap member defining the spatial extent of the first segments along the axis of rotation and an outer shell member for containing the first segments between the first tubular inner member and the first tubular outer member.

13. The pump of claim 9 wherein the first segments comprise a tungsten based alloy.

14. The pump of claim 9 wherein the first tubular inner member is in an interference fit with at least one of the first number of first segments.

15. The pump of claim 9 wherein the first inner tubular member is configured to be in a splined engagement with the rotatable operable shaft of the pump.

16. The pump of claim 9, further comprising:

a second flywheel being configured to rotate around said axis of rotation, wherein the second flywheel comprises:

a second tubular inner member having an outer diameter;

a second tubular outer member having an inner diameter;

a number of second segments provided in a second tubular space defined between the outer diameter of the second tubular inner member and the inner diameter of the second tubular outer member, said outer diameter of the inner member and said inner diameter of the outer member respectively defining a second inner segment diameter and a second outer segment diameter of said segments, wherein the second tubular inner member, the second tubular outer member and the number of second segments are operably coupled to said shaft and being configured for rotation therewith around said axis of rotation, wherein the second tubular outer member is in an interference fit with at least one of the second segments, wherein a preselected gap is provided between each of the second segments and is structured to accommodate thermal expansion of the second segments, and wherein the second flywheel further comprises a second upper pin and a second lower pin, said second lower pin positioned lower than said second upper pin in a direction along the axis of rotation provided at each gap between the segments at the second inner segment diameter; and wherein the second flywheel is in opposed relation to the first flywheel.

17. The pump of claim 16, further comprising:

a pump casing, wherein the first and second flywheels are located within the pump casing and are structured to allow coolant to circulate in order to reduce the risk of destroying the first and second flywheels.

18. The pump of claim 9 in combination with a nuclear power plant.

19. The combination of claim 18 wherein the nuclear power plant is structured to generate at least 1000 MWe.

20. The combination of claim 18 wherein the nuclear power plant has a pressurized water reactor.

21. A flywheel for a pump, said flywheel being configured to rotate around an axis of rotation, the flywheel comprising:

an tubular inner member having an outer diameter;

an tubular outer member having an inner diameter;

a number of segments provided in a tubular space defined between the outer diameter of the inner member and the inner diameter of the outer member, said outer diameter of the tubular inner member and said inner diameter of the tubular outer member respectively defining an inner segment diameter and an outer segment diameter of said segments, wherein the inner member, the outer member and the number of segments are operably coupled to a rotatably operable shaft of the pump for rotation therewith, wherein the inner member is keyed to the segments, wherein the outer member is in an interference fit with at least one of the segments, wherein a preselected gap is provided between each of the segment and is structured to accommodate thermal expansion of the segments, and wherein the rotatable flywheel further comprises an upper pin and a lower pin, said lower pin positioned lower than said upper pin in a direction along the axis of rotation provided at each gap between the segments at the inner segment diameter.

22. A pump comprising:

a shaft being configured to rotate around an axis of rotation;

an impeller mounted on the shaft;

a motor engaged with the shaft for turning the impeller; and a flywheel mounted on the shaft and configured to rotate with said shaft around said axis of rotation, the flywheel comprising:

an tubular inner member having an outer diameter;

an tubular outer member having an inner diameter;

a number of segments provided in a tubular space defined between the outer diameter of the tubular inner member and the inner diameter of the tubular outer member, said outer diameter of the tubular inner member and said inner diameter of the tubular outer member respectively defining an inner segment diameter and an outer segment diameter of said segments, wherein the inner member, the outer member and the number of segments are operably coupled to a rotatably operable shaft of the pump for rotation therewith, wherein the inner member is keyed to the segments, wherein the outer member is in an interference fit with at least one of the segments, wherein a preselected gap is provided between each of the segments and is structured to accommodate thermal expansion of the segments, and wherein the rotatable flywheel further comprises an upper pin and a lower pin, said lower pin positioned lower than said upper pin in a direction along the axis of rotation provided at each gap between the segments at the inner segment diameter.

* * * * *